US005472277A

United States Patent [19]

Dedoes

[11] Patent Number: 5,472,277

[45] Date of Patent: Dec. 5, 1995

[54] PAINT CAN COVER ASSEMBLY

[75] Inventor: John T. Dedoes, Brighton, Mich.

[73] Assignee: Dedoes Industries, Inc., Walled Lake, Mich.

[21] Appl. No.: 259,500

[22] Filed: Jun. 14, 1994

[51] Int. Cl.[6] ..... B01F 7/16

[52] U.S. Cl. ..... 366/247; 220/324; 366/605

[58] Field of Search ..... 366/279, 242, 366/244, 245, 247, 249, 250, 251, 605, 347, 281; 99/348; 220/324; 248/147, 154

[56] References Cited

U.S. PATENT DOCUMENTS

| | | | |
|---|---|---|---|
| 2,269,736 | 1/1942 | Rogers | 366/247 |
| 4,225,248 | 9/1980 | Para | 366/605 |
| 4,380,399 | 4/1983 | Godat | 366/605 |
| 4,407,584 | 10/1983 | Boudin | 366/279 |
| 4,501,500 | 2/1985 | Terrels | 366/605 |

*Primary Examiner*—Robert W. Jenkins
*Attorney, Agent, or Firm*—Gifford, Krass, Groh, Sprinkle, Patmore, Anderson & Citkowski

[57] ABSTRACT

A cover assembly for a paint can having an open top and an inwardly extending chime is disclosed. The cover assemble includes a lid dimensioned to overlie the open top of the can and the lid has a spout for dispensing the contents of the can. Similarly, a paint stirrer is connected to the lid and extends downwardly into the paint can when the lid is secured to the paint can. A pair of locking feet are also provided detachably securing the lid to the paint can and each locking foot includes an elongated shank pivotally mounted to the lid and a laterally outwardly extending portion which extends under the paint can chime thus locking the lid to the paint can. Each locking foot, furthermore, includes a metallic inner core and an outer sheath constructed of a material which is non-oxidizable by water.

4 Claims, 1 Drawing Sheet

PAINT CAN COVER ASSEMBLY

BACKGROUND OF THE INVENTION

I. Field of the Invention

The present invention relates to a cover assembly for a paint can.

II. Description of the Prior Art

There are a number of previously known cover assemblies which are designed to overlie the open top of a paint can. Such cover assemblies include a spout with a cooperating closure which selectively opens and closes the spout. With the spout open, paint can be dispensed from the can.

Many of these previously known cover assemblies also include a spout stirring assembly which extends downwardly into the interior of the can once the lid is attached to the open top of the paint can. The stirring assembly cooperates with a drive mechanism in a paint can rack which engages the paint stirring assembly to continuously stir the paint while the paint can is stored on the rack. Such paint cover assemblies, together with the paint can racks, are conventionally used in automotive body repair shops and the like.

These previously known assemblies have typically been constructed of zinc for low cost manufacture and high durability. Such previously known zinc cover assemblies have proven adequate for use with paints utilizing hydrocarbon solvents.

In response to environmental concerns as well as to government regulations, more and more paints now utilize water as the solvent for the paint rather than hydrocarbon based solvents. Such water based solvents do not adversely affect the environment, and particularly the ozone layer of the environment, as the paints dry.

These previously known cover assemblies, however, cannot be utilized with water based paints since the water in the water based paint reacts with the zinc by oxidizing the zinc.

Consequently, in order to prevent oxidization of the cover assembly by the water in water based paints, here have been previously known cover assemblies in which the lid and the components which contact the paint are constructed of a material, such as plastic, which cannot be oxidized by water. Similarly, since the locking feet which secure the paint can lid to the paint can chime contact the paint, the locking feet of these previously known lids have been constructed of plastic or similar material.

The use of plastic for the locking feet, however, has not proven entirely satisfactory. In particular, since the locking feet are subjected to some stress and forces by the locking mechanism, these previously known plastic locking feet tend to deflect under load. Such deflection creates an inadequate seal between the lid and the paint can. Even worse, these previously known plastic locking feet, when subjected to a load, can deform and break.

SUMMARY OF THE PRESENT INVENTION

The present invention provides a cover assembly for a pint can which overcomes all of the above mentioned disadvantages of the previously known devices.

In brief, the cover assembly of the present invention is provided for a paint can having an open top and a radially inwardly extending chime formed around the open top of the can.

A lid is dimensioned to overlie the open top of the can. A spout is formed on the lid and a closure assembly cooperates with the spout for selectively opening the spout for dispensing paint and closing the spout when dispensing the paint is not required. Paint stirring means are also carried by the lid.

In the preferred embodiment, the lid is constructed of a material which cannot be oxidized by water, such as plastic. Other materials can, however, alternatively be used.

In order to detachably secure the lid to the paint can, a pair of locking feet are provided on opposite sides of the paint can lid. Each locking foot includes an elongated shank which is pivotally mounted to the paint can about an axis parallel to the axis of the paint can. A foot then extends laterally outwardly from a lower end of each shank. Each foot is pivotal between a locking position, in which the chime is sandwiched in between the locking foot and the pint can lid, and an unlocked position in which the foot is positioned radially inwardly from the paint can chime.

Each locking member further includes an inner core constructed of a metallic material, such as zinc, for its high strength and rigidity characteristics. An outer sheath then covers the inner metallic core and this outer sheath is constructed of a material, such as plastic, which is non-oxidizable by water.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which.

DETAILED DESCRIPTION OF A PREFERRED EMBODIMENT OF THE PRESENT INVENTION

Figure 1:
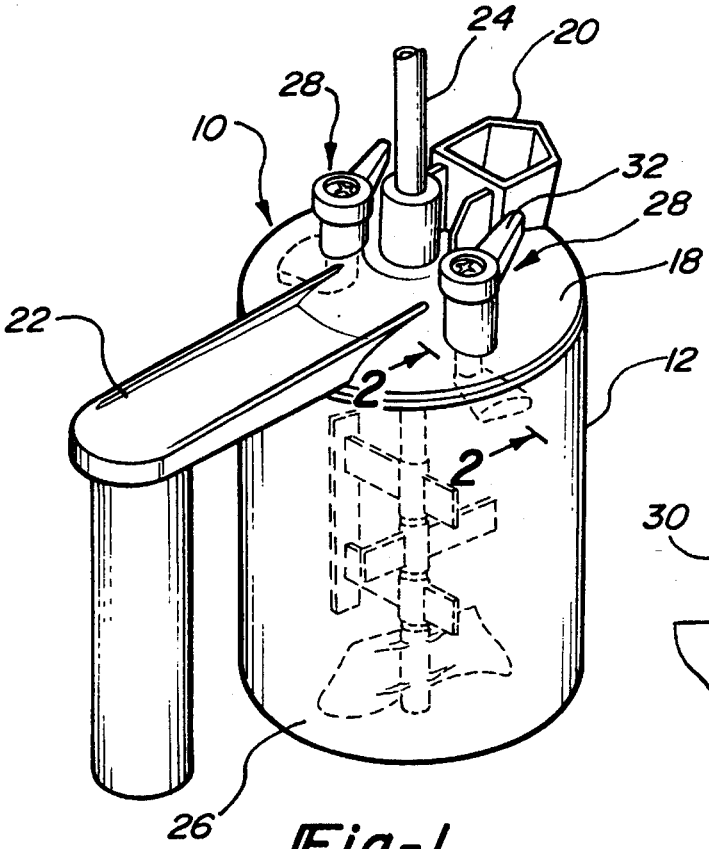
FIG. 1 is an elevational view illustrating a preferred embodiment of the present invention.

With reference first to FIG. 1, a preferred embodiment of a cover assembly 10 of the present invention is thereshown for use with a paint can 12. The paint can 12 is generally cylindrical in shape and has an open top 14. A radially inwardly chime 16 is formed around the open top 14 of the can 12.

Referring now particularly to FIG. 1, the cover assembly 10 includes a lid 18 which is adapted to overlie and cover the open top 14 of the paint can 12. A spout 20 is formed on the lid for dispensing paint from the interior of the can 12 while a handle 22 extends outwardly from the lid 18 for manipulating the cover assembly 10 with the paint can 12. The lid 18, spout 20 and handle 22 are constructed for a material which is not oxidized by water, such as plastic.

A paint stirring means 24 is rotatably mounted to the cover 18 and has a portion 20 which extends downwardly into the interior of the can. The paint stirring means 24 is used to mix the paint within the interior of the can 12 and may be of any conventional construction.

Likewise, the lid 18, spout 20 and handle 22 may be of any conventional construction. However, the lid 18, spout 20 and handle 22 are preferably constructed of a material which is not oxidizable by water. Preferably, the lid 18, spout 20 and handle 22 are constructed of plastic.

Referring again to FIGS. 1 and 2, a pair of locking assemblies 28 are provided for selectively detachably locking the paint can lid 18 to the paint can 12. Each locking assembly 28 includes a locking member 30 and locking lever 32.

Figure 2:
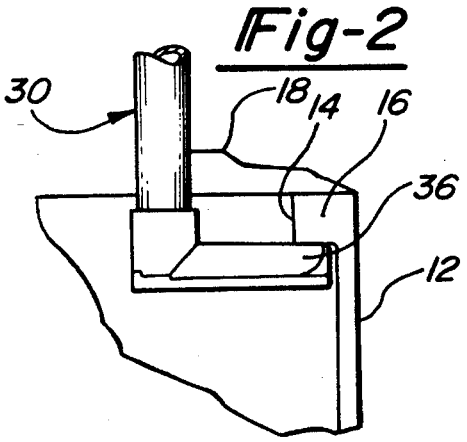
FIG. 2 is a view taken substantially line 2—2 in FIG. 1 and enlarged for clarity.
Figure 3:
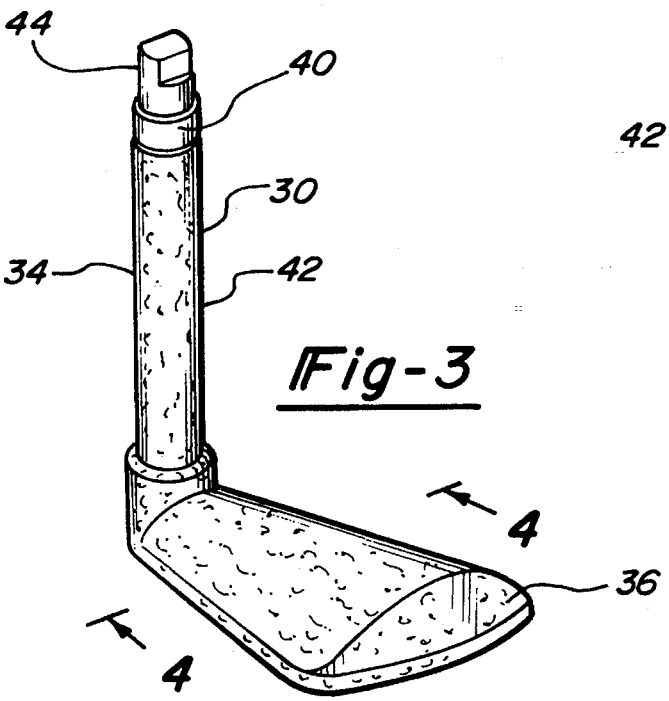
FIG. 3 is an elevational view illustrating a preferred embodiment of the locking member of the present invention.

With reference now to FIGS. 2 and 3, each locking member 30 includes an elongated shank 34 and a locking foot 36 which extends laterally outwardly from the lower end of the shank 34. The shank 34, moreover, is pivotally mounted within an aperture formed through the lid 18 so that each shank 34 extends generally parallel to the axis of the can 12.

The locking levers 32 are utilized to pivot the locking members 30 between a locked position and an unlocked position. In the locked position, illustrated in FIG. 2, a portion of the chime 16 is sandwiched in between the locking foot 36 and the lid 18. Conversely, when the locking member 30 is pivoted by the locking levers 32 to its unlocked position, the locking foot 36 is moved to a position spaced radially inwardly from the chime 14 thus permitting the cover assembly 10 to be removed from the paint can 12.

Figure 4:
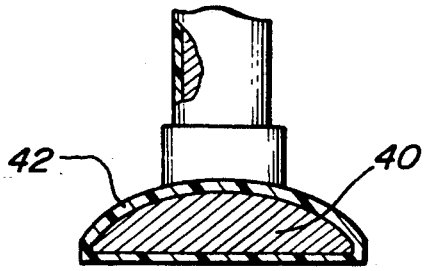
FIG. 4 is a cross sectional view taken along line 4—4 in FIG. 3.

With reference now to FIGS. 3 and 4, each locking member 30 comprises a one piece inner core 40 which is make of a metallic material, such as zinc, for high strength and rigid construction. This metallic core 40, furthermore, extends substantially along the entire length of the shank 34 and along substantially the entire length of the locking foot 36.

Each locking member 30 further includes an outer sheath 42 which covers the entire portion of the locking members 30 which extends into the interior of the paint can 12. This sheath 42 is constructed of a material which is not oxidizable by water and, preferably, is constructed of plastic. An upper portion 44 (FIG. 3) of each shank 30 is positioned above the lid 18 and is not covered by the sheath 42. The locking levers 32 are then secured to this upper portion 44 of the shank 30.

The cover assembly of the present invention is most advantageously used with water based paints. All components of the lid which are open to the interior of the paint can are constructed of a material which is not oxidizable by water. Furthermore, the special construction of the locking feet enjoy high rigidity and high strength for the locking feet while remaining rust resistant to water.

Having described my invention, however, many modifications thereto will become apparent to those skilled in the art to which it pertains without deviation from the spirit of the invention as defined by the scope of the appended claims.

I claim:

1. A cover assembly for a paint can having an open top and an inwardly extending chime, said cover assembly comprising:

a lid dimensioned to overlie the open top of the paint can, said lid having a spout, paint stirring means connected to said lid and extending downwardly into the paint can when said lid is secured to the can, a pair of locking members for detachable securing said lid to the paint can so that said lid overlies the open top of the paint can, each locking member having an elongated shank pivotally mounted in a bore in said lid so that an axis of said shank is substantially parallel to an axis of the paint can, each locking member having a foot extending laterally outwardly from one end of each shank, said shank being pivotal between a locked position in which said foot is positioned beneath the chime and an unlocked position in which said foot is positioned radially inwardly from said chime, and wherein each locking member comprises a core made of a metallic material and an outer sheath make of a material non-oxidizable by water.

2. The invention as defined in claim 1 wherein said core extends for substantially the entire length of said shank and said laterally outwardly extending foot.

3. The invention as defined in claim 1 wherein said core is made of zinc.

4. The invention as defined in claim 1 wherein said outer sheath is made of plastic.

* * * * *

UNITED STATES PATENT AND TRADEMARK OFFICE

CERTIFICATE OF CORRECTION

PATENT NO. : 5,472,277

DATED : December 5, 1995

INVENTOR(S) : John T. Dedoes

It is certified that error appears in the above-indentified patent and that said Letters Patent is hereby corrected as shown below:

On the title page, item [57]

| | |
|---|---|
| Abstract, | line 2, delete "assemble" and insert --assembly--; |
| | line 7, after "provided" insert --for--. |
| Column 1, | line 25, after "known", insert --cover--; |
| | line 41, delete "here" and insert --there--; |
| | line 62, delete "pint" and insert --paint--. |
| Column 2, | line 16, delete "pint" and insert --paint--; |
| | line 50, after "inwardly" insert --extending--; |
| | line 58, delete "for" and insert --of--; |
| | line 61, delete "20" and insert --26--. |
| Column 3, | line 27, delete "make" and insert --made--. |

UNITED STATES PATENT AND TRADEMARK OFFICE

CERTIFICATE OF CORRECTION

PATENT NO. : 5,472,277

DATED : December 5, 1995

INVENTOR(S) : John T. Dedoes

It is certified that error appears in the above-indentified patent and that said Letters Patent is hereby corrected as shown below:

Column 4, line 20, delete "detachable" and insert --detachably--;
line 32, delete "make" and insert --made--.

Signed and Sealed this

Sixteenth Day of April, 1996

Bruce Lehman

BRUCE LEHMAN

*Commissioner of Patents and Trademarks*

*Attest:*

*Attesting Officer*